US006783617B2

(12) United States Patent
Lorenzen

(10) Patent No.: US 6,783,617 B2
(45) Date of Patent: Aug. 31, 2004

(54) METHOD OF DENSIFYING STREAMS OF FILTER MATERIAL FOR TOBACCO SMOKE

(75) Inventor: Heinz-Christen Lorenzen, Wentorf (DE)

(73) Assignee: Hauni Maschinenbau AG, Hamburg (DE)

( * ) Notice: Subject to any disclaimer, the term of this patent is extended or adjusted under 35 U.S.C. 154(b) by 36 days.

(21) Appl. No.: 09/778,807

(22) Filed: Feb. 8, 2001

(65) Prior Publication Data

US 2001/0013387 A1 Aug. 16, 2001

(30) Foreign Application Priority Data

Feb. 12, 2000 (DE) ..... 100 06 372

(51) Int. Cl.[7] ..... B29C 53/52

(52) U.S. Cl. ..... 156/73.2; 156/73.6; 156/178; 156/201; 156/203; 493/42; 493/45; 493/50

(58) Field of Search ..... 493/42, 45, 50, 493/736, 73.2, 178, 203, 436, 461, 379.6, 201; 131/84.2

(56) References Cited

U.S. PATENT DOCUMENTS 3,646,855 A 3/1972 Müller
3,729,777 A 5/1973 Hoffmann et al.
3,941,036 A 3/1976 Molins et al.
3,974,007 A 8/1976 Greve
4,046,064 A * 9/1977 Wahle ..... 226/195
4,412,505 A 11/1983 Hä
5,135,008 A 8/1992 Oesterling et al.
5,163,452 A * 11/1992 Marritt et al. ..... 131/331

FOREIGN PATENT DOCUMENTS

DE 25 28 906 A1 1/1977
EP 0928566 A1 * 7/1999

* cited by examiner

*Primary Examiner*—Michael W. Ball
*Assistant Examiner*—Barbara J. Musser
(74) *Attorney, Agent, or Firm*—Venable LLP; Robert Kinberg; Stuart I. Smith

(57) ABSTRACT

A filter rod making machine wherein successive increments of a stream constituting a converted tow of filamentary filter material for tobacco smoke are contacted by a compressing tool which is vibrated at a frequency and/or amplitude sufficient to prevent over-heating of the tool and/or of filaments of filter material, such as acetate fibers. Conversion of the tow into the stream and the wrapping of the compressed stream into a running web of filter paper are carried out in a conventional manner.

10 Claims, 2 Drawing Sheets

METHOD OF DENSIFYING STREAMS OF FILTER MATERIAL FOR TOBACCO SMOKE

CROSS-REFERENCE TO RELATED CASES

The present application claims the priority of the commonly owned copending German patent application Serial No. 100 06 372.1 filed Feb. 12, 2000. The disclosure of the above-referenced German patent application, as well as that of each US and foreign patent and patent application identified in the specification of the present application, is incorporated herein by reference.

BACKGROUND OF THE INVENTION

The present invention relates to improvements in so-called rod making machines, and more particularly to improvements in methods of and apparatus for treating tows, streams, fillers and similar accumulations of filamentary material in such machines.

Rod making machines are utilized extensively in many branches of industry, for example, in connection with the making of catamenial tampons, in connection with the making of drinking straws and particularly in connection with the making of plain or filter cigarettes, cigars, cigarillos and other rod-shaped smokers' products. The following passages of this specification will deal primarily with the making of filter cigarettes, cigars or cigarillos; however it is to be understood that the method and apparatus of the present invention can also be practiced and utilized in connection with the making of numerous other types of rod-shaped products which contain a single type or several types of filamentary material.

A rod making machine which is utilized to turn out filter mouthpieces for tobacco smoke is normally designed to process filamentary filter material (such as cellulose acetate fibers) for tobacco smoke. The machine produces a continuous filter rod wherein a rod-shaped core (called filler) is surrounded by a tubular envelope or wrapper of so-called filter paper. The rod is advanced lengthwise and its front end portion is severed at required intervals to form a file of discrete filter sections or mouthpieces of unit length or multiple unit length. Such mouthpieces are fed into the magazine of a so-called filter tipping machine wherein the mouthpieces are connected with plain cigarettes, cigars or cigarillos (hereinafter referred to as plain cigarettes) to form therewith filter cigarettes of unit length or multiple unit length. Reference may be had, for example, to commonly owned U.S. Pat. No. 5,135,008 granted Aug. 4, 1992 to Oesterling et al. for "METHOD OF AND APPARATUS FOR MAKING FILTER CIGARETTES".

Filter rod making machines which deliver filter rod sections or mouthpieces of desired length to a machine of the type described and illustrated in the patent to Oesterling et al. (or to an analogous machine) can be constructed and assembled in a manner as disclosed, for example, in U.S. Pat. No. 3,974,007 granted Aug. 10, 1976 to Greve for "METHOD AND APPARATUS FOR THE PRODUCTION OF FILTER ROD SECTIONS OR THE LIKE" and in U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE". More recent versions of filter rod making machines of the type described and shown in the U.S. patents to Greve and Häusler et al. are those known as KDF 1, KDF 2 and KDF 3; such machines are distributed by the assignee of the present application. Machines which are utilized to furnish filamentary filter material for tobacco smoke to filter rod making machines can be of the type known as AF 1, AF 2 and AF 3 (also distributed by the assignee of the present application).

A filter rod making machine of the type disclosed in the aforementioned U.S. patents to Greve and Häusler et al. converts a tow of filamentary filter material which is drawn from a suitable source (such as a bale of compacted filter material) and is subjected to several treatments on its way to a wrapping apparatus or unit wherein the properly processed tow constitutes a continuous rod-like filler or stream ready to be draped into a running web of filter paper, cigarette paper or the like. The thus obtained filter rod is ready to be severed in a so-called cutoff to yield a file or series of filter rod sections or mouthpieces of desired length. Such cutoff normally employs a rotary knife which repeatedly moves across the path for the filter rod while advancing with and at the speed of the rod; this ensures the making of clean cuts devoid of tears, rough edges or the like.

On its way to or in the aforementioned wrapping unit, the processed tow must undergo a compressing or condensing action in order to ensure that the cross-sectional area of each of a series of successive increments of the processed tow will match or sufficiently approximate a certain cross-sectional area which is desirable for several reasons, e.g., to facilitate and ensure proper wrapping of the filler and/or to ensure that each ultimate product (filter mouthpiece) will have a prescribed (such as circular or oval) cross-sectional outline. This is accomplished by subjecting successive increments of the running processed tow to the compressive action of a suitable implement or tool which is or which can be located close to the wrapping unit.

The treatment to which a tow of filamentary filter material is subjected in the path leading from a source (such as a bale) to the wrapping unit normally includes longitudinal stretching and simultaneous or immediately following transverse spreading (singularizing) of the filaments of the tow to form a layer of more or less parallel filaments. Such filaments are contacted by a finely atomized spray of a suitable liquid softening agent (such as triacetin) prior to entry of successive increments of the stretched, spread out and sprayed upon tow into a so-called horn which imparts to the tow the shape of a rod-like filler ready to be subjected to a further compressing or densifying or condensing treatment by the aforementioned implement; such implement normally is or can be located at the inlet of the wrapping unit.

The purpose of the atomized softening agent is to ensure that portions of neighboring filaments in the tow adhere to each other on their way through the gathering horn, during teatment by the compressing implement (finger) and/or during wrapping. Such filaments establish a maze of discrete narrow paths for the flow of tobacco smoke from the lighted end of a filter cigarette into the mouth of a smoker; this is intended to greatly enhance the filtering action, e.g., the ability of the mouthpiece to intercept nicotine and/or condensate.

The wrapping material normally employed in the wrapping unit of a filter rod making machine is a web or strip of so-caleld filter paper one marginal portion of which is provided with one or more films of a suitable adhesive (such as a hot melt) and is bonded to the other marginal portion. The overlapping marginal portions form a seam which extends longitudinally of the tubular envelope or wrapper of the finished filter rod. The filter paper is or can but need not be foraminous. The leader of the thus obtained finished filter rod is ready to be severed by the cutoff.

The implement or finger which is employed to further compress the rod-like filler of pretreated filamentary filter material downstream of the gathering horn, preferably at the inlet of the wrapping unit, is normally oriented (relative to the path for the filler) in such a way that, as seen in the direction of movement of the filler toward the wrapping unit, the filler-contacting surface of the implement slopes downwardly toward a belt conveyor which supports and advances the filler toward the wrapping unit. The shortest distance between such surface and the belt conveyor equals or approximates the desired diameter of the compressed filler.

The tow, such as a tow consisting of cellulose acetate fibers, offers a pronounced resistance to the compressing action of the implement. Therefore, the maintaining of the implement in continuous pronounced frictional engagement with the running processed tow results in the generation of pronounced heat which, in view of the high speed at which the tow is being advanced in a modern filter rod making machine, suffices to entail a melting of the filamentary material. As a rule, such partial melting of filaments at the upper side of the tow adjacent the locus of entry of successive increments of the tow into the wrapping unit is highly undesirable, primarily because the smoke filtering quality of filter mouthpieces containing partially molten filter material is inferior to the quality of mouthpieces containing filamentary filter material which does not contain molten filaments. In addition, overheated filaments can discolor and/or otherwise affect the appearance and/or other qualities of the tubular wrapper.

OBJECTS OF THE INVENTION

An object of the present invention is to provide a novel and improved method of enhancing the quality of rod-shaped fillers which contain compressible filamentary material, such as cellulose acetate fibers of the type confined in the filter mouthpieces for tobacco smoke.

Another object of the invention is to provide a novel and improved method of treating a stream of filamentary material on its way to the wrapping unit in a filter rod making machine which is designed to turn out rod-shaped filter mouthpieces for tobacco smoke.

A further object of the invention is to provide a novel and improved method of compressing a processed tow of acetate fibers in a filter rod making machine which is utilized in a production line for the making of filter cigarettes, cigars, cigarillos and analogous rod-shaped smokers' products.

An additional object of the invention is to provide a method which renders it possible to avoid overheating of a processed tow of filamentary material, particularly filter material for tobacco smoke.

Still another object of the invention is to provide a method which can be practiced by resorting to relatively simply but highly effectively modified existing filter rod making machines.

A further object of the instant invention is to provide a novel and improved apparatus which can be put to use in a rod making machine to enable such machine to practice the above outlined method.

Another object of the invention is to provide a novel and improved apparatus which can be utilized for the practice of the above outlined method and can be installed in existing machines or production lines as a superior substitute for presently known apparatus.

An additional object of the present invention is to improve that portion of a machine for the making of filter mouthpieces for tobacco smoke which precedes the wrapping mechanism or unit wherein successive increments of the processed tow are draped into a running web of filter paper or the like.

Still another object of this invention is to provide a novel and improved implement which is constructed, dimensioned, configurated and operable to ensure highly satisfactory compression of a running stream or filler of filamentary material, such as cellulose acetate fibers, in or at the wrapping mechanism or unit of a rod making machine.

A further object of the invention is to provide a novel and improved machine for the making of filter rods adapted to be subdivided into filter mouthpieces of unit length or multiple unit length which can be processed in so-called tipping machines.

Another object of the present invention is to provide a method of and an apparatus for mass production of high-quality filter mouthpieces for tobacco smoke.

An additional object of the invention is to provide filter mouthpieces for tobacco smoke which are superior to those capable of being turned out at the same rate by presently known machines for the making of filter rods and filter mouthpieces for tobacco smoke.

SUMMARY OF THE INVENTION

One feature of the present invention resides in the provision of a method of processing filamentary material, particularly filamentary (fibrous) filter material for tobacco smoke. The improved method comprises the steps of advancing a compressible stream of filamentary material lengthwise in a predetermined direction along a predetermined path having at least one selected portion wherein successive increments of the advancing stream are at least partly accessible, and reducing the cross-sectional areas of successive increments in the at least one selected portion of the path. The reducing step includes at least intermittently contacting successive increments of the advancing stream by a portion of a stream compressing implement and repeatedly moving such portion of the implement relative to the at least one selected portion of the path.

The stream can contain or consist of cellulose acetate fibers.

The moving step can include vibrating the aforementioned portion of the stream compressing implement, preferably at a frequency in the ultrasonic range (e.g., between about 5 and 50 kilohertz). The vibratory movements of the aforesaid portion of the implement can have an amplitude in the range of between about 3 and 55 micrometers.

The portion of the implement can be vibrated exclusively in and counter to the direction of movement of the stream along its path, exclusively transversely of such direction, or with a component of movement in at least one of the directions longitudinally and transversely of the path.

The reducing step can include imparting to successive increments of the stream a predetermined cross-sectional outline, and such method can further comprise the step of thereafter (i.e., subsequent to completion of the reducing step) confining the stream in a tubular wrapper to thus convert the stream into the filler of a continuous rod composed of the compressed stream and of the tubular wrapper which surrounds the compressed stream. The confining step of such method can include conveying a strip of wrapping material (such as filter paper) in the predetermined direction along the path downstream of the at least one selected portion of the path, applying to one marginal portion of the strip at least one film of an adhesive (such as a hot melt), and converting the strip into the tubular wrapper including contacting the adhesive-coated one marginal portion with another marginal portion of the strip.

The method can further comprise the steps of establishing a source (such as a bale) of a continuous tow of filter material at a second portion of the path upstream of the at least one selected portion, and converting the tow into the stream in the path between the second portion and the at least one selected portion of such path. The converting step can include stretching the tow in the predetermined direction, simultaneously or thereafter or therebefore spreading the tow transversely of the predetermined direction, applying droplets of a softening agent (such as triacetin) to the filter material of the spread-out tow, and thereupon gathering the tow into the aforementioned stream.

Another feature of the present invention resides in the provision of an apparatus for processing filamentary material, such as fibrous filter material for tobacco smoke. The improved apparatus comprises means for advancing a compressible stream of filamentary material lengthwise in a predetermined direction along a predetermined path having at least one selected portion wherein successive increments of the advancing stream are at least partly exposed and accessible, and means for reducing the cross-sectional areas of successive increments of the advancing stream in the at least one selected portion of the path. Such reducing means includes a compressing implement having a portion which at least intermittently contacts the stream in the at least one selected portion of the path, and means for repeatedly moving the portion of the implement relative to the increments of the advancing stream in the at least one selected portion of the path.

The means for moving can include means for vibrating the portion of the implement at a frequency in the ultrasonic range, e.g., between 5 and 50 kilohertz. Furthermore the means for moving can include means for imparting to the portion of the implement vibratory movements having an amplitude within a range of between about 3 and 55 micrometers.

Still further, the means for moving can include means for vibrating the portion of the implement in and counter to the predetermined direction, transversely of the predetermined direction, or in a direction in which the vibratory movements of the portion of the implement have a component of movement in the predetermined direction, transversely of the predetermined direction and/or in one or more additional directions.

The aforementioned portion of the implement can be provided with a stream-contacting surface extending in the predetermined direction.

The aforementioned portion of the implement can comprise or can consist of steel, and such portion of the implement can constitute a powder metallurgically produced part.

The improved apparatus further comprises means for confining successive increments of the advancing stream in a tubular wrapper downstream of the at least one selected portion of the path. Such confining means can include a mechanism wherein the stream is draped into a running elongated web of wrapping material having an adhesive-coated first marginal portion contacting a second marginal portion to form therewith a seam extending longitudinally of the tubular wrapper.

Still further, the apparatus can comprise a source of a continuous tow of filamentary material at a second portion of the path upstream of the at least one selected portion, and means for converting the tow into the aforementioned stream in the predetermined path between the second portion at the at least one selected portion of such path. The converting means can include means for stretching the tow in the predetermined direction, means for preferably simultaneously spreading the tow transversely of the predetermined direction, means for applying droplets of a softening agent (such as triacetin if the filamentary material is fibrous filter material for tobacco smoke) to the material of the spread-out tow, and means for thereupon gathering the tow into the stream.

A further feature of the present invention resides in the provision of a method of processing filamentary material. The method comprises the steps of advancing a stream of filamentary material lengthwise along a predetermined path, and subjecting the advancing stream to a plurality of treatments in several portions of the path. At least one of these treatments includes establishing a frictional engagement between the advancing stream and at least one stream-compressing implement, and the method further comprises the step of maintaining the rise of temperature of the stream (namely that rise which is attributable to frictional engagement between the stream and the at least one implement) below a predetermined value, preferably below that value at which the filaments are likely to or actually melt.

The maintaining step preferably includes imparting to the at least one implement a high-frequency vibratory movement relative to the stream in the respective portion of the path.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
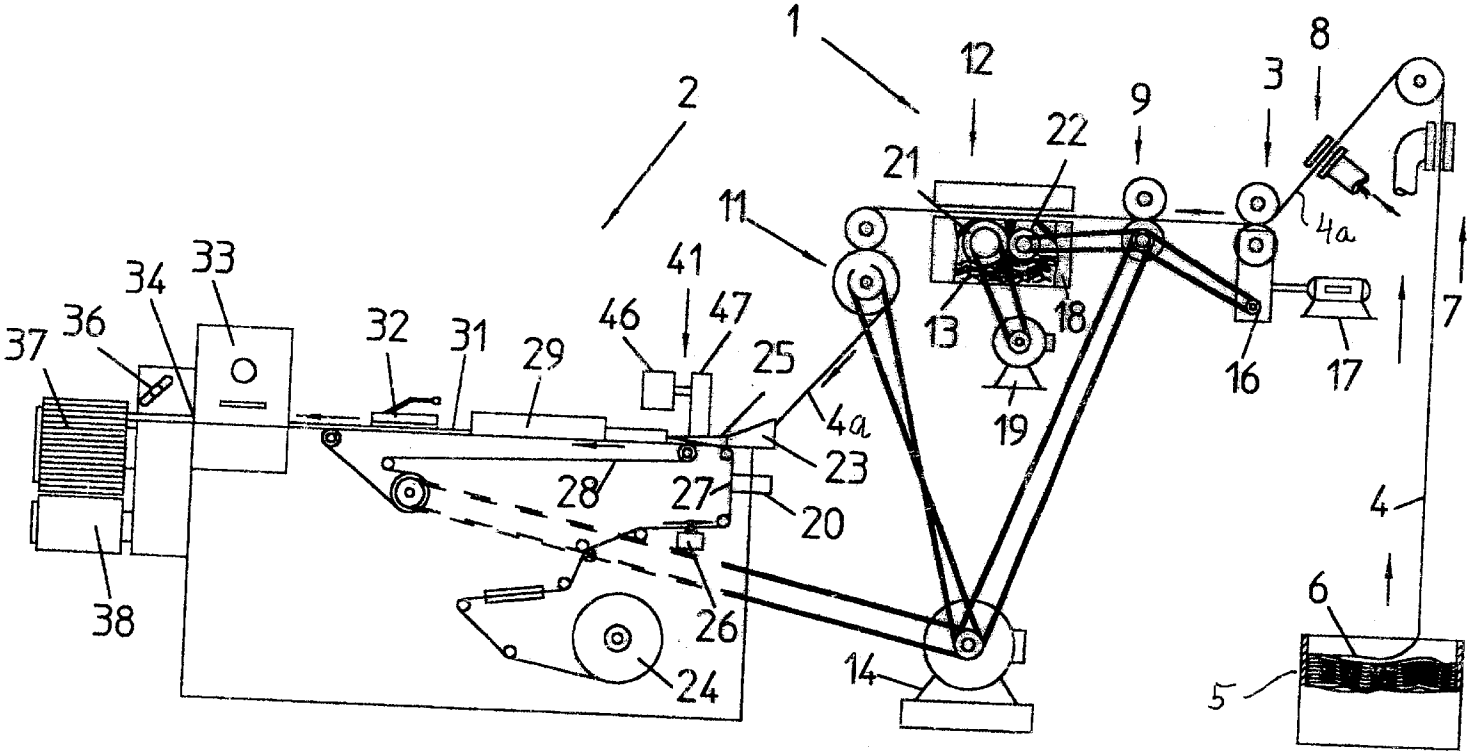
FIG. 1 is a schematic elevational view of a filter rod making machine including an apparatus which embodies one form of the present invention.

FIG. 1 shows certain relevant constituents of a rod making machine including an assembly 1 which converts a continuous tow 4 of crimped filamentary material (such as acetate fibers utilized for the making of filter mouthpieces for tobacco smoke) into a continuous stream 43 (FIG. 2), and an assembly 2 which processes the stream and a continuous web of strip 27 of wrapping material (such as cigarette paper or so-called filter paper) into a continuous rod 31, e.g., a filter rod. The leader of the rod 31 (this rod is assumed to constitute a filter rod) is repeatedly severed by the rotary knife of a so-called cutoff 33 to yield a series or file of successive filter mouthpieces 34 of desired or required length, and such mouthpieces are fed into the magazine of a filter tipping machine, e.g., into the magazine 11 shown in FIG. 1 of the aforementioned U.S. Pat. No. 5,135,008 to Oesterling et al. This magazine receives filter mouthpieces of six times unit length because the patented tipping machine is provided with rotary knives which subdivide each mouthpiece (12) of six times unit length into three mouthpieces (16) of double unit length.

The assembly 1 shown in FIG. 1 of the present application is or can be similar to or identical with that disclosed in the aforementioned U.S. Pat. No. 3,974,007 to Greve, in the aforementioned U.S. Pat. No. 4,412,505 to Häusler et al., or in the aforementioned machine known as AF 1 or AF 2 distributed by the assignee of the present application. This assembly comprises a pair of rollers 3 one of which is driven by a transmission 16. The rollers 3 advance the tow 4 along a stretch of an elongated path having a (selected) portion or section adjacent the inlet of a wrapping mechanism or unit 29 forming part of the assembly 2 and a second portion or section adjacent the outlet of a container 5 for a bale 6 constituting a source of tow 4. The arrow 7 indicates the direction of advancement of successive increments of the tow 4 from the container 5 toward the nip of the rollers 3.

The reference character 8 denotes one of two so-called banding devices which serve to discharge jets of compessed air adapted to spread the filaments of the tow 4 in a direction at right angles to the plane of FIG. 1 (i.e., transversely of the direction indicated by the arrow 7); the thus treated tow 4 constitutes a flat layer 4*a* of neighboring filaments which are further stretched (straightened) in the path portion or section between the nip of the rollers 3 and the nip of the rollers 9 one of which is driven by a variable-speed prime mover 14 (e.g., an electric motor) by way of one or more endless belts, bands or chains. One or more additional belts serve to transmit torque from the driven roller 9 to the input element of the transmission 16; the ratio of this transmission is variable by an electrc motor 17 to thus select the speed of movement of the tow 4 from the bale 6 to the nip of the rollers 3 and/or the extent to which the aforementioned layer 4*a* is further stretched between the rollers 3 and 9.

The rollers 9 are followed by a further pair of rollers 11 one of which is driven by the prime mover 14; the rollers 11 cooperate with the rollers 9 to define an elongated horizontal or substantially horizontal portion, section or stretch of the path for the layer 4*a*. The underside of this layer is contacted by a spray of an atomized softening or plasticizing agent 13 which softens portions of the filaments sufficiently to ensure that neighboring filaments adhere to each other starting in the nip of the rollers 11 and thereupon during conversion of successive increments of the thus treated layer 4*a* into the aforementioned filler or stream 43.

The softening agent 13 is dispensed by an applicator 12 which is installed between the pairs of rollers 9 and 11 and comprises a receptacle 18 for a supply of softening agent. This receptacle accommodates a rotary drum 21 which dips into the supply of softening agent 13 and delivers a film of such substance into the range of bristles provided at and extending from the periphery of a wheel 22 which sprays atomized softening agent against the underside of the layer 4*a* advancing at a level above the upper side of the receptacle 18. The drum 21 is driven by an electric motor 19 or another suitable prime mover, and the rotary brush 22 receives torque from the driven roller 9.

One of the rollers 9 is preferably provided with a circumferentially grooved peripheral surface which contacts a smooth cylindrical peripheral surface provided on an elastic radially outermost layer of the other of these rollers. The rollers 11 can be configurated in the same way as the rollers 9. The peripheral speed of the rollers 3 is less than that of the rollers 9, and the peripheral speed of the rollers 11 can equal or exceed that of the rollers 9.

The assembly 2 can be similar to or (except for the structure shown in detail in FIG. 2) identical with that forming part of the aforementioned machine known as KDF 1, KDF 2 or KDF 3 distributed by the assignee of the present application. This assembly 2 comprises the aforementioned gathering horn 23 which is a substantially funnel-shaped device tapering in the direction of forward (lengthwise) movement of the layer 4*a* and converts the latter into the stream 43 (referenced in FIG. 2) preferably having a circular or substantially circular cross-sectional outline with a diameter exceeding that of the rod-like filler in the tubular wrapper of the finished filter rod 31.

Figure 2:
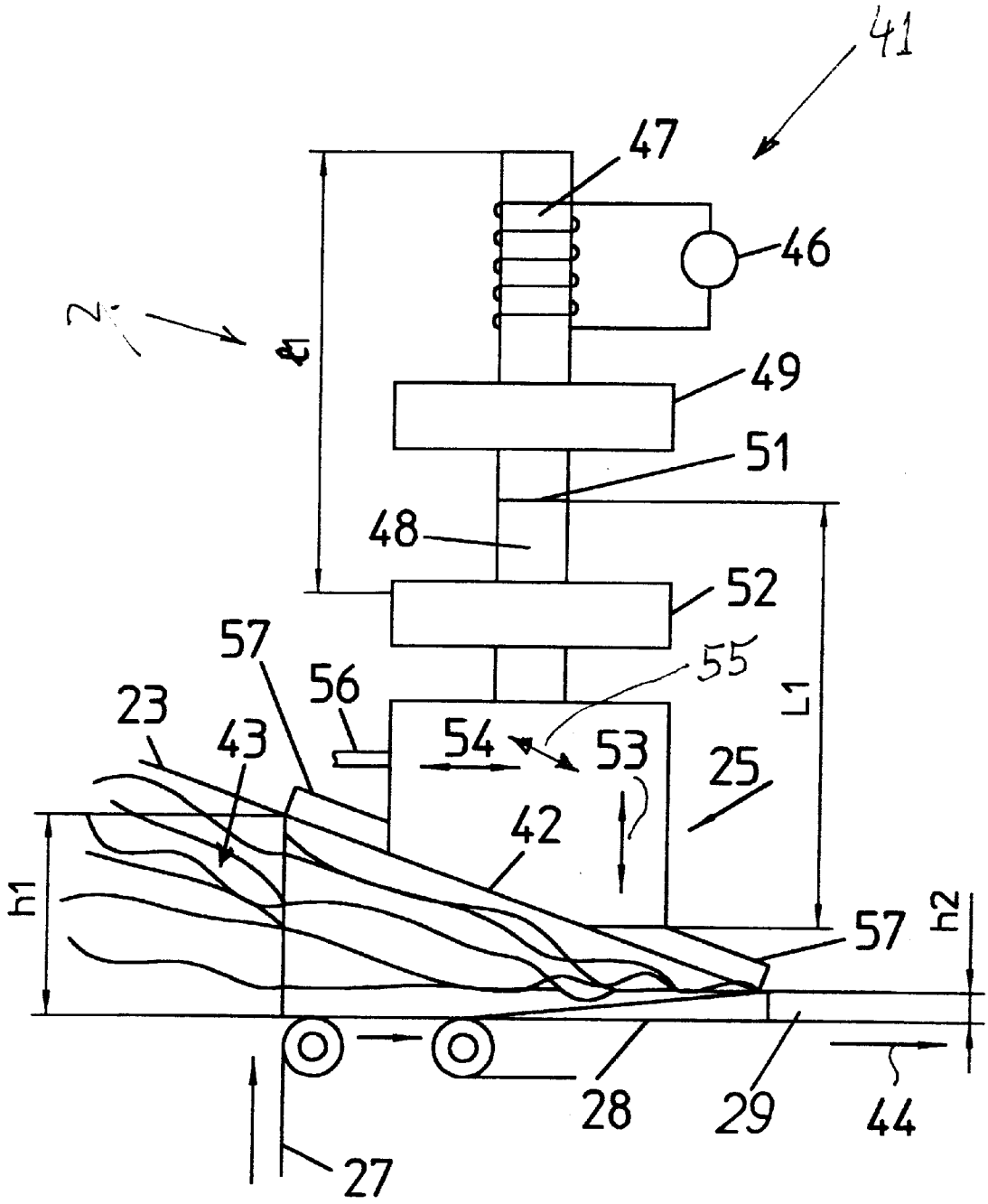
FIG. 2 is a greatly enlarged view of a detail of the improved apparatus.

The means for reducing the cross-sectional area of the stream 43 includes a compressing or condensing implement or tool 25 (called finger) having a forwardly and downwardly sloping stream contacting surface 42 overlying successive increments of the advancing stream 43 in the aforementioned selected section or portion of the elongated path for the tow 4, layer 4*a*, stream 43 and filter rod 31. In the apparatus of FIGS. 1 and 2, this selected section or portion of the path is located between the gathering horn 23 and the inlet of the wrapping mechanism or unit 29.

The wrapping mechanism or unit 29 draws a continuous web or strip 27 of filter paper or another suitable wrapping material from a bobbin 24 and advances successive increments of one marginal portion at least of the running web along a paster 26 which applies to such marginal portion at least one film of a suitable adhesive paste (e.g., a hot melt). It is often preferred to apply at least one further film of adhesive to that side of the web 27 which is to be contacted by the filler stream because this ensures that the web 27 adheres to the surface of the stream 43 once the adhesive was caused or permitted to set; this reduces the likelihood of undesirable stray movements between the converted web 27 and the filler of the filter rod 31.

The means for advancing the web 27 and the stream 43 through the wrapping mechanism or unit 29 comprises an endless belt or band conveyor 28 (known as garniture) which drapes the web around the stream 43 to thus convert the web into a continuous cylindrical envelope or wrapper wherein one of the marginal portions of the draped web overlies and adheres to the other marginal portion to form therewith a seam extending longitudinally of the filter rod 31.

The assembly 2 which is shown in FIG. 1 employs the aforementioned paster 26 as well as a second paster 20. The paster 26 is utilized to apply a film of adhesive to the underside of the adjacent portion of the running web 27, and the paster 20 can comprise at least one heated nozzle which applies a film of hot melt or another suitable adhesive to one marginal portion of the web. Such arrangement even more reliably ensures desirable adherence of the inner side of the tubular wrapper to the rod-like filler of the filter rod 31 as well as the establishment of a reliable seam wherein the two marginal portions of the converted web 27 adhere to each other without the danger of bursting of the seam, particularly during severing of the filter rod 31 in or at the cutoff 33. The seam of the tubular wrapper of the filter rod 31 advances past a so-called sealer 32 which cools the adhesive film(s) between the overlapping marginal portions of the web 27 in a path portion or section disposed between the wrapping unit or mechanism 29 and the cutoff 33.

The cutoff 33 comprises a rotary knife (not specifically shown) which moves in and counter to the direction of forward movement of the filter rod 31 and moves across the path of the filter rod while moving in the direction of advancement and at the exact speed of the filter rod. As already mentioned hereinbefore, the cutoff 33 is set up to divide the leader of the running filter rod 31 into mouthpieces 34 of six times unit length if such filter mouthpieces are fed into the magazine of a tipping machine of the type shown in FIG. 1 of U.S. Pat. No. 5,135,008 to Oesterling et al.

Successive filter mouthpieces 34 are accelerated by an orbiting cam 36 which propels such mouthpieces into successive axially parallel peripheral flutes of a driven drum-shaped conveyor 37; the latter deposits successive filter mouthpieces 34 on the upper reach or stretch of an endless belt or band or chain conveyor 38 which moves the mouthpieces sideways toward or directly into the magazine of the tipping machine.

Referring now to FIG. 2, the compressing implement or finger 25 has an elongated surface (underside) 42 which slopes forwardly and downwardly toward the upper reach or stretch of the garniture 28, namely in the direction of arrow 44 which indicates the direction of movement of the web 27 and stream 43 in and beyond the wrapping mechanism or unit 29. The purpose of that portion of the implement 25 which is provided with the surface 42 is to reduce the cross-sectional areas of successive increments of the running stream 43 to a size less than that imparted by the gathering horn 23 (or to reduce the cross-sectional area anew if the cross-sectional area imparted by the gathering horn is satisfactory but the tendency of the stream 43 to expand is rather pronounced, i.e., if the stream was allowed to expand on its way from the horn 23 to the wrapping mechanism or unit 29). FIG. 2 shows that the compressing implement 25 is or can be affixed to (or even made of one piece with) the gathering horn 23 which latter is or can be mounted in the frame or housing of the assembly 2.

The dimensions, the slope and/or the distance of the surface 42 of the compressing implement 25 from the upper reach or stretch of the garniture 28 is or can be selected in such a way that the cross-sectional area of each of successive increments of the stream 43 at the inlet of the wrapping mechanism or unit 29 equals or approximates (e.g., is somewhat less than) the cross-sectional area of the rod-like filler in the tubular wrapper of the filter rod 31. The stream 43 offers a pronounced resistance to the compressing or condensing or compacting action of the implement 25. Therefore, and in the absence of any undertaking(s) to reduce or to prevent an overheating and resultant melting of filaments advancing along and being in contact with the surface 42, the quality of the filler of the rod 31 would be quite unsatisfactory owing to frictional engagement between the surface 42 and the adjacent filaments of the stream 43, especially if the stream 43 is being advanced (arrow 44) at a high or very high speed as required in a modern filter rod making machine.

In accordance with an important feature of the present invention, the assembly 2 is provided with means for repeatedly moving that portion of the implement 25 which is provided with the surface 42 relative to the neighboring increments of the advancing stream 43, namely relative to those increments which are being moved in the aforementioned selected portion of the path defined in part by the upper reach of the garniture 28. Such movability of the surface 42 relative to the adjacent increments of the advancing stream 43 is selected to ensure that the rise of temperature of those filaments of the stream 43 which frictionally engage the surface 42 of the implement 25 is below a predetermined value, i.e., below a value at which the frictionally engaged filaments are heated to melting temperature (as is the case in conventional filter rod making machines wherein the stream of filamentary filter material is advanced at a relatively high or very high speed past and in continuous (uninterrupted) contact with a stationary compressing tool).

The means for moving the implement 25 (or at least that portion of this implement which is provided with the surface 42) comprises a vibrator 41. FIG. 2 shows the implement 25 drawn to a scale exceeding the actual size. The surface 42 reduces the heights of successive increments of the advancing stream 43 from a value $\underline{h}1$ to a value $\underline{h}2$, i.e., to a relatively or very small fraction of the original height. This entails a pronounced compression or compacting of the filamentary material of the stream 43 with attendant rise of the temperature of such filamentary material. At least a portion of the surface 42 of the implement 25 is or can be concave with a radius of curvature which can match or approximate the radius of the filler of the filter rod 31. It is presently preferred to select the configuration of the surface 42 in such a way that its radius of curvature decreases in the direction of the arrow 44; this ensures a desirable gradual conversion of the stream 43 into a rod-like filler having a diameter which matches or approximates the diameter of the filter rod 31.

The vibrator 41 comprises an oscillator 46 which controls a motion imparting unit 47 serving to oscillate the surface 42 at a frequency which is preferably in the ultrasonic range, e.g., within a range of between 5 and 55 kilohertz. The drawing shows a magnetostrictive coupling between the oscillator 46 and the unit 47; however, other types of couplings, such as piezoelectric couplings, can be utilized with equal or similar advantage. The amplitude of vibrations is or can be in the range of between 3 and 55 micrometers. The reference character 48 denotes in FIG. 2 a booster which is operatively connected with the unit 47. The latter has a first nodal point 49. The booster 48 amplifies the vibratory movements at the surface 51 of the unit 47, and this booster has a second nodal point 52.

At the nodal points 49 and 52, the amplitudes of the standing ultrasonic waves extending through the unit 47 and the booster 48 are at least close to zero, so that these points can readily serve as points for securing the unit 47, the booster 48 and the implement 25 to the bed of the machine 2.

The implement 25 is provided with extensions 57 one of which extends in and the other of which extends counter to the direction indicated by the arrow 44. These extensions define portions of the sloping surface 42; such lengthening of the surface 42 (due to the provision of one or two extensions 57 or similar extensions) is desirable and advantageous in many instances. The dimensions $\lambda 1$ and L1 of the parts 47, 48 and 25 are preferably matched with the wavelength $\lambda$ of the standing ultrasonic waves, e.g., in such a way that L1 equals $\lambda$ and $\lambda 1$ equals $m \times \lambda/4$ wherein m is a natural number, preferably an odd number greater than one.

The exact frequency and/or amplitude of oscillations of the implement 25 (or at least of that portion of this implement which is provided with the stream-contacting surface 42) within or even without the aforementioned ranges can be determined experimentally, e.g., to even more accurately select the desirable or optimum characteristics of the movements being imparted to the surface 42. The optimum frequency and/or amplitude of oscillations of the surface 42 of the implement 25 depends, among other factors, upon the finish of the surface 42 and/or upon the nature of filaments in the stream 43. The presently preferred oscillation frequency is between 5 and 50 kilohertz, and the presently preferred amplitude of oscillations is between 8 and 55 micrometers. As already mentioned above, the exact frequency and/or amplitude of oscillations can be determined empirically in a rather simple manner.

The illustrated unit 47 is or can be set up to move the surface 42 of the implement 25 in the directions indicated by the double-headed arrow 53, i.e., at least substantially at right angles to the direction (arrow 44) of forward movement of the stream 43. However, and if one resorts to the expedient of utilizing another vibrator (a portion of such vibrator is shown at 56) in addition to or in lieu of or interchangeably with the component 47, the surface 42 can be caused to move in the directions indicated by a double-headed arrow 54, namely in and counter to the directions indicated by the arrow 44. Still further, it is possible to employ an oscillating unit (not shown) which is adapted to reciprocate the surface 42 in directions indicated by an arrow 55, i.e., with one or more components of movement in the direction of arrow 53 and/or 54.

The implement 25 (or at least that portion thereof which is provided with the surface 42) is or can be made of a high-quality steel which can stand pronounced wear for long periods of use. The finish (smoothness) of the surface 42 also contributes to longer useful life of the implement 25 and to a reduction of temperatures due to frictional engagement with the filaments of the stream 43. It is presently preferred to employ an implement 25 which is made of high-quality steel in accordance with the powder metallurgical technique.

The implement 25 can be cooled, e.g., with streams of cold air or another fluid medium, to further reduce the likelihood of overheating of filaments advancing along the surface 42.

It has been ascertained that the aforedescribed moving means 41 or an equivalent thereof can effectively prevent melting of portions of or of entire filaments at the points of frictional contact with the surface 42 of the implement 25 or an equivalent or analogous implement. This enhances the quality of the filter mouthpieces 34, even if the stream 43 is caused to advance at a very high speed. Another advantage of the improved method and apparatus is that the energy consumption by the apparatus is well below that by conventional apparatus because a lesser force is required to properly advance the stream 43 toward, through and beyond the wrapping unit 29.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of densifying streams of filter material for tobacco smoke and, therefore, such adaptations should and are intended to be comprehended within the meaning and range of equivalence of the appended claims.

What is claimed is:

1. A method of processing filter material for tobacco smoke, comprising the steps of:

advancing a stream of compressible fibrous filter material lengthwise in a predetermined direction along a predetermined path having at least one selected portion wherein successive increments of the advancing stream are at least partly accessible; and reducing the cross-sectional areas of said successive increments to form the stream in a tubular cross-sectional outline in said at least one selected portion of said path, including at least intermittently contacting said successive increments by a portion of a stream compressing implement and repeatedly vibrating the portion of the implement in both the predetermined direction and a direction perpendicular to the predetermined direction.

2. The method of claim 1, wherein the stream contains cellulose acetate fibers.

3. The method of claim 1, wherein said vibrating step includes vibrating said portion of the implement at a frequency in the ultrasonic range.

4. The method of claim 3, wherein said range is between about 5 and 50 kilohertz.

5. The method of claim 1, wherein said vibrating said portion of the implement includes vibrating at an amplitude within the range of between about 3 and 55 micrometers.

6. The method of claim 1, wherein said reducing step includes imparting to successive increments of the stream a predetermined cross-sectional outline, and further comprising the step of thereafter confining the stream in a tubular wrapper to thus convert the stream into a filler of a continuous rod.

7. The method of claim 6, wherein said confining step includes conveying a strip of wrapping material in said direction along said path downstream of said selected portion, applying to one marginal portion of the strip at least one coating of an adhesive, and converting the strip into said tubular wrapper including contacting the one marginal portion with another marginal portion of the strip.

8. The method of claim 1, further comprising the steps of establishing a source of a continuous tow of filter material at a second portion, and converting the tow into said stream in said path between said second portion and said selected portion.

9. The method of claim 8, wherein said converting step includes stretching the tow in said predetermined direction, simultaneously spreading the tow transversely of said direction, applying droplets of a softening agent to the filter material of the spreadout tow, and thereupon gathering the tow into said stream.

10. A method of processing filamentary material, comprising the steps of:

advancing a stream of filamentary material lengthwise along a predetermined path;

subjecting the advancing stream to a plurality of treatments in several portions of said path, at least one of said treatments including establishing a frictional engagement between the advancing stream and at least one stream-compressing implement, the stream-compressing implement vibrating in both the predetermined direction and a direction perpendicular to the predetermined direction; and maintaining the rise of temperature of the stream, as a result of frictional engagement with the at least one implement, below a predetermined value by imparting movement to the stream by the implement.

* * * * *